US007550019B2

(12) United States Patent
Krull et al.

(10) Patent No.: US 7,550,019 B2
(45) Date of Patent: Jun. 23, 2009

(54) FUEL OIL ADDITIVES AND ADDITIZED FUEL OILS HAVING IMPROVED COLD PROPERTIES

(75) Inventors: Matthias Krull, Harxheim (DE); Heinz Hoffmann, Bayreuth (DE); Klaus Redlich, Bayreuth (DE)

(73) Assignee: Clariant Produkte (Deutschland) GmbH, Sulzbach (DE)

( * ) Notice: Subject to any disclaimer, the term of this patent is extended or adjusted under 35 U.S.C. 154(b) by 601 days.

(21) Appl. No.: 10/896,128

(22) Filed: Jul. 21, 2004

(65) Prior Publication Data

US 2005/0016060 A1 Jan. 27, 2005

(30) Foreign Application Priority Data

Jul. 21, 2003 (DE) ..... 103 33 043

(51) Int. Cl.
*C10L 1/18* (2006.01)
*C10L 1/22* (2006.01)

(52) U.S. Cl. ..... 44/393; 44/408; 44/418; 44/459

(58) Field of Classification Search ..... 44/408, 44/418, 393, 459
See application file for complete search history.

(56) References Cited

U.S. PATENT DOCUMENTS

| | | | | |
|---|---|---|---|---|
| 3,807,975 | A | 4/1974 | Mieville | |
| 4,211,534 | A | 7/1980 | Feldman | |
| 4,670,516 | A | 6/1987 | Sackmann et al. | |
| 4,713,088 | A | 12/1987 | Tack et al. | |
| 4,985,048 | A | 1/1991 | Wirtz et al. | |
| 5,186,720 | A | 2/1993 | Feustel et al. | |
| 5,391,632 | A | 2/1995 | Krull et al. | |
| 5,585,337 | A | 12/1996 | Day | |
| 5,766,273 | A | 6/1998 | Draue-Voss et al. | |
| 5,998,530 | A | 12/1999 | Krull et al. | |
| 6,010,989 | A * | 1/2000 | Krull et al. | 508/475 |
| 6,508,848 | B1 | 1/2003 | Peiffer | |
| 6,767,374 | B1 | 7/2004 | Goberdhan | |

FOREIGN PATENT DOCUMENTS

| | | |
|---|---|---|
| CA | 2017126 | 11/1990 |
| DE | 254 955 | 3/1988 |
| EP | 0061894 | 10/1982 |
| EP | 0082399 | 6/1983 |
| EP | 0815184 | 1/1998 |
| EP | 1302526 | 4/2003 |
| GB | 1525804 | 9/1978 |

OTHER PUBLICATIONS

Abstract for EP 0082399, 0629/1883.
Abstract and Translation of JP 11 106 764, Apr. 20, 1999.
Abstract and Translation of JP 11 148 085, Jun. 2, 1999.
Abstract and Translation of JP 2000-256684, Sep. 19, 2000.
N.A. Plate & V.P. Shibaev, J. Polymer Sci.: Macromolecular Reviews, vol. 8, Comb-like polymers, structure and properties, p. 117-253 (1974).

* cited by examiner

*Primary Examiner*—Cephia D Toomer
(74) *Attorney, Agent, or Firm*—Richard P. Silverman

(57) ABSTRACT

The invention therefore provides an additive for improving the cold flow performance of middle distillates, comprising I) at least one paraffin dispersant which is a derivative of a fatty amine, II) at least one block copolymer of the structure $(AB)_nA$ or $(AB)_m$, where A represents blocks which are composed of olefinically unsaturated, aromatic monomers, and B represents blocks which are composed of structural elements based on polyolefins and are capable of cocrystallizing with the paraffins precipitating out of the middle distillate in the course of cooling, and n is a number in the range from 1 to 10 and m is a number in the range from 2 to 10.

14 Claims, No Drawings

FUEL OIL ADDITIVES AND ADDITIZED FUEL OILS HAVING IMPROVED COLD PROPERTIES

The present invention relates to mineral oils and mineral oil distillates having improved cold properties and to a polymeric additive for improving the cold properties.

Crude oils and middle distillates, such as gas oil, diesel oil or heating oil, obtained by distillation of crude oils, contain, depending on the origin of the crude oils, different amounts of n-paraffins which crystallize out as platelet-shaped crystals when the temperature is reduced and sometimes agglomerate with the inclusion of oil. This causes a deterioration in the flow properties of these oils or distillates, which may result in disruption, for example, in the course of extraction, transport, storage and/or use of the mineral oils and mineral oil distillates. In the case of mineral oils, this crystallization phenomenon can cause deposits on the pipe walls in the course of transport through pipelines, especially in winter, and in individual cases, for example in the event of stoppage of a pipeline, can even lead to its complete blockage. The precipitation of paraffins can also cause difficulties in the course of storage and further processing of the mineral oils. In winter, for instance, it may be necessary under some circumstances to store the mineral oils in heated tanks. In the case of mineral oil distillates, the consequence of crystallization may be blockage of the filter in diesel engines and boilers, which prevents reliable metering of the fuels and in some cases results in complete interruption of the fuel or heating medium feed.

In addition to the classical methods of eliminating the crystallized paraffins (thermal, mechanical or using solvents), which merely involve the removal of the precipitates which have already formed, chemical additives (known as flow improvers or paraffin inhibitors) have been developed in recent years and, by interacting physically with the precipitating paraffin crystals, lead to the modification of their shape, size and adhesion properties. The additives function as additional crystal seeds and some of them crystallize out with the paraffins, resulting in a larger number of smaller paraffin crystals having modified crystal shape. Some of the action of the additives is also explained by dispersion of the paraffin crystals. The modified paraffin crystals have a lower tendency to agglomerate, so that the oils admixed with these additives can still be pumped and processed at temperatures which are often more than 20 K lower than in the case of nonadditized oils.

The flow and cold performance of mineral oils and mineral oil distillates is described by specifying the cloud point (determined to ISO 3015), the pour point (determined to ISO 3016) and the cold filter plugging point (CFPP; determined to EN 116). These parameters are measured in ° C.

Typical flow improvers for crude oils and middle distillates are copolymers of ethylene with one or more carboxylic esters of vinyl alcohol, for example EVA copolymers. Copolymers of ethylene with olefins, for example propylene, and also block copolymers are also known to be cold flow improvers.

Scientific publications disclose that certain block copolymers have a tendency toward microphase separation, i.e. domains form which consist exclusively of one of the blocks. In certain solvents, a sparingly soluble block A of the copolymer forms a type of micelle core, while a more soluble block B is solvated and forms a swollen shell. In the case of triblock copolymers of the A-B-A structure, the more sparingly soluble A blocks may belong to different micelles. The bridging of these micelles by the B block forms a type of network. They form gels in solvents.

Block copolymers are especially well known as materials and as a component for materials, where they are valued for their properties as a thermoplastic elastomer. In addition, applications in oils are also known.

JP-A-11 106 764 and JP-A-11 148 085 disclose block copolymers of the styrene-butadiene/isoprene-styrene type for reducing the CFPP and the pour point of low-sulfur or heavy middle distillates. These are alternatives to EVA copolymers and other known pour point depressants for middle distillates. The block copolymers are optionally used together with polyoxyalkylene derivatives.

JP-A-2000-256684 discloses the same block copolymers as JP-A-111 06 764/JP-A-11148 085 for reducing the CFPP and the pour point of middle distillates, which here also may be used together with polyoxyalkylene derivatives. The block copolymers have a glass transition temperature determined by means of DSC of from −10 to 80° C.

U.S. Pat. No. 3,807,975 discloses middle distillates such as diesel, jet fuel and gas oil having improved pumpability in cold conditions, which contain additives based on copolymers of ethylene with propylene, vinyl acetate, amino alkyl esters or acrylic esters to attain a pour point of below −18° C. and, additionally, 50-1 000 ppm of certain copolymers of styrene and butadiene to improve the filterability in cold conditions. The styrene-butadiene copolymers have a molecular weight of up to 5 000 and contain from 10 to 30% by weight of styrene. No structure of the copolymers is specified.

DE-A-2 711 218 discloses fuel oils which, in addition to alkyl hydroxycarboxylates, contain substances including a hydrogenated styrene-butadiene copolymer ($M_w$ 96 000, 27% styrene, 63% butadiene) as a pour point depressant.

EP-A-0 815 184 and EP-A-1 302 526 disclose hydrogenated block copolymers of dienes as cold flow improvers for middle distillates. The blocks consist of crystalline blocks of 1,4-bonded dienes on the one hand and noncrystalline blocks of 1,2-bonded linear dienes and/or branched dienes on the other. The block copolymers are used in combination with known cold flow improvers.

DD-254 955 discloses EVA-polystyrene-EVA block copolymers having 0.4-12% by weight of polystyrene as flow improvers for middle distillates. However, the polystyrene block which is less soluble in mineral oil here forms the middle block, so that gel formation via microphase separation, typical for a triblock copolymer, cannot occur here.

EP-A-0 082 399 discloses that ethylene copolymers prepared by customary free-radical polymerization processes may be reacted with living polymers prepared by anionic polymerization to give block copolymers. The ethylene blocks contain polar comonomers such as acrylates; the living radicals are based on homopolymers of styrene or dienes, or on their copolymers having a more or less random structure. These block copolymers may be added to substances including mineral oils.

In view of the decreasing crude oil reserves coupled with steadily rising energy demand, ever more problematic crude oils are being extracted and processed. In addition, the demands on the fuel oils, such as diesel and heating oil, produced therefrom are becoming ever more stringent, not least as a result of legislative requirements. Examples thereof are the reduction in the sulfur content, the limitation of the final boiling point and also of the aromatics content of middle distillates, which force the refineries into constant adaptation of the processing technology. It is therefore desirable to have cold flow improvers having an improved efficiency compared to the prior art and also having a broadened spectrum of effectiveness in these oils.

The additization with classical flow improvers based on ethylene and unsaturated esters such as vinyl and acrylic esters reduces the size of the paraffin crystals precipitating out of middle distillates on cooling and thus improves the filterability of the oils below the cloud point. However, the now reduced viscosity of the oil results in the paraffin crystals tending to sediment as a consequence of their higher specific density compared to the middle distillate, leading to an increased paraffin concentration and therefore to an increased cloud point at the bottom of the storage vessel. To improve the paraffin dispersancy, polar nitrogen compounds are additionally added to these oils.

However, the paraffin dispersancy in middle distillates is in many cases unsatisfactory using prior art additives. In the case of oils having a low paraffin content, the paraffin dispersancy is often difficult, especially in the case of the cold-critical chain length range of $C_{16}$-$C_{22}$, since the particles cannot be kept suspended by mutual repulsion. In addition, high paraffin contents, as may occur at temperatures well below the cloud point, among other circumstances, are difficult to disperse. Particularly problematic in this context are oils having a low content of aromatics, since the solubility of the paraffins decreases particularly sharply below the cloud point. Additives are therefore being sought which lead, especially in critical oils and at low storage temperatures, to improved paraffin dispersancy.

The olefin copolymers already described as cold additives are random copolymers of ethylene and relatively long-chain olefins for which, by cocrystallizing with paraffins precipitating out of middle distillates in cold conditions, reduce their crystal size and thus lead to improved filterability of the oils in cold conditions. However, they make no contribution to the dispersancy of the paraffin crystals.

It has been found that improved paraffin dispersancy is achieved in middle distillates when an additive composed of a block copolymer and a derivative of a fatty amine is added to it.

The invention therefore provides an additive for improving the cold flow performance of middle distillates, comprising I) at least one paraffin dispersant which is a derivative of a fatty amine, II) at least one block copolymer of the structure $(AB)_nA$ or $(AB)_m$, where A represents blocks which are composed of olefinically unsaturated, aromatic monomers, and B represents blocks which are composed of structural elements based on polyolefins and are capable of cocrystallizing with the paraffins precipitating out of the middle distillate in the course of cooling, and n is a number in the range from 1 to 10 and m is a number in the range from 2 to 10.

The invention further provides a middle distillate which comprises an above-defined additive.

The invention further provides the use of an additive as defined above for improving the cold flow performance of middle distillates.

The invention further provides a process for improving the cold flow performance and/or the paraffin dispersancy of middle distillates by adding to it an additive as defined above.

The paraffin dispersants which are suitable according to the invention are preferably reaction products of fatty amines with compounds which contain an acyl group. The preferred amines are preferably compounds of the formula $NR^6R^7R^8$ where $R^6$, $R^7$ and $R^8$ may be the same or different, and at least one of these groups is $C_8$-$C_{36}$-alkyl, $C_6$-$C_{36}$-cycloalkyl or $C_8$-$C_{36}$-alkenyl, in particular $C_{12}$-$C_{24}$-alkyl, $C_{12}$-$C_{25}$-alkenyl or cyclohexyl, and the remaining groups are either hydrogen, $C_1$-$C_{36}$-alkyl, $C_2$-$C_{36}$-alkenyl, cyclohexyl, or a group of the formulae $-(A\text{-}O)_x\text{-}E$ or $—(CH_2)_n—NYZ$, where A is an ethyl or propyl group, x is a number from 1 to 50, E=H, $C_1$-$C_{30}$-alkyl, $C_5$-$C_{12}$-cycloalkyl or $C_6$-$C_{30}$-aryl, and n=2, 3 or 4, and Y and Z are each independently H, $C_1$-$C_{30}$-alkyl or $-(A\text{-}O)_x$. The alkyl and alkenyl radicals may each be linear or branched and contain up to two double bonds. They are preferably linear and substantially saturated, i.e. they have iodine numbers of less than 75 g of $I_2$/g, preferably less than 60 g of $I_2$/g and in particular between 1 and 10 g of $I_2$/g. Particular preference is given to secondary fatty amines in which two of the $R^6$, $R^7$ and $R^8$ groups are each $C_8$-$C_{36}$-alkyl, $C_6$-$C_{36}$-cycloalkyl, $C_8$-$C_{36}$-alkenyl, in particular $C_{12}$-$C_{24}$-alkyl, $C_{12}$-$C_{24}$-alkenyl or cyclohexyl. Suitable fatty amines are, for example, octylamine, decylamine, dodecylamine, tetradecylamine, hexadecylamine, octadecylamine, eicosylamine, behenylamine, didecylamine, didodecylamine, ditetradecylamine, dihexadecylamine, dioctadecylamine, dieicosylamine, dibehenylamine and mixtures thereof. The amines especially contain chain cuts based on natural raw materials, for example coconut fatty amine, tallow fatty amine, hydrogenated tallow fatty amine, dicoconut fatty amine, ditallow fatty amine and di(hydrogenated tallow fatty amine). Particularly preferred amine derivatives are amine salts, imides and/or amides, for example amide-ammonium salts of secondary fatty amines, in particular of dicoconut fatty amine, ditallow fatty amine and distearylamine.

Acyl group refers here to a functional group of the following formula:

$$>C{=}O$$

Carbonyl compounds suitable for the reaction with amines are either low molecular weight or polymeric compounds having one or more carboxyl groups. Preference is given to those low molecular weight carbonyl compounds having 1, 2, 3 or 4 carbonyl groups. They may also contain heteroatoms such as oxygen, sulfur and nitrogen. Suitable carboxylic acids are, for example, maleic acid, fumaric acid, crotonic acid, itaconic acid, succinic acid, $C_1$-$C_{40}$-alkenylsuccinic acid, adipic acid, glutaric acid, sebacic acid and malonic acid, and also benzoic acid, phthalic acid, trimellitic acid and pyromellitic acid, nitrilotriacetic acid, ethylenediaminetetraacetic acid and their reactive derivatives, for example esters, anhydrides and acid halides. Useful polymeric carbonyl compounds have been found to be in particular copolymers of ethylenically unsaturated acids, for example acrylic acid, methacrylic acid, maleic acid, fumaric acid and itaconic acid; particular preference is given to copolymers of maleic anhydride. Suitable comonomers are those which confer oil solubility on the polymer. Oil-soluble means here that the copolymer, after reaction with the fatty amine, dissolves without residue in the middle distillate to be additized in practically relevant dosages. Suitable comonomers are, for example, olefins, alkyl esters of acrylic acid and methacrylic acid, alkyl vinyl esters, alkyl vinyl ethers having from 2 to 75, preferably from 4 to 40 and in particular from 8 to 20, carbon atoms in the alkyl radical. In the case of olefins, the alkyl radical bonded here to the double bond is equivalent. The molecular weight of the polymeric carbonyl compounds are preferably between 400 and 20 000, more preferably between 500 and 10 000, for example between 1 000 and 5 000.

It has been found that paraffin dispersants which are obtained by reaction of aliphatic or aromatic amines, preferably long-chain aliphatic amines, with aliphatic or aromatic mono-, di-, tri- or tetracarboxylic acids or their anhydrides are particularly useful (cf. U.S. Pat. No. 4,211,534). Equally suitable as paraffin dispersants are amides and ammonium salts of aminoalkylenepolycarboxylic acids such as nitrilotriacetic acid or ethylenediaminetetraacetic acid with secondary amines (cf. EP 0 398 101). Other paraffin dispersants are copolymers of maleic anhydride and α,β-unsaturated compounds which may optionally be reacted with primary monoalkylamines and/or aliphatic alcohols (cf. EP-A-0 154 177, EP 0 777 712), the reaction products of alkenyl-spirobislactones with amines (cf. EP-A-0 413 279 B1) and, according to EP-A-0 606 055 A2, reaction products of terpolymers based on α,β-unsaturated dicarboxylic anhydrides, α,β-unsaturated compounds and polyoxyalkylene ethers of lower unsaturated alcohols.

In the block copolymer, the type A blocks have a low solubility in middle distillates and aggregate as a result of microphase separation to form micelle-like structures, while the B blocks have oil-soluble structures and can cocrystallize at least partly with the paraffins. A prerequisite is that they dissolve clearly in the middle distillate at least at elevated temperatures (e.g. 50° C.).

Suitable block copolymers are known per se and some are commercially available, for example under the trademark Kraton™.

The blocks A and B may be homopolymers, random or tapered copolymers, as long as the dissolution properties for the particular blocks remain characteristic. For instance, the A blocks may contain, for example, copolymer blocks of styrene-co-methylstyrene or styrene-co-butadiene, as long as the individual blocks exhibit the properties of a poly(vinylaromatic). The A blocks preferably consist of more than 80%, in particular of from 90 to 100%, of monoalkenylaryl units.

Suitable A blocks are monoalkenylaryl polymers which are derived from styrene and its homologs such as o-methylstyrene, p-methylstyrene, p-propylstyrene, p-tert-butylstyrene, 1,3-dimethylstyrene, alpha-methylstyrene, vinyinaphthalene, vinylanthracene and similar compounds. Preferred monomers are monocyclic monovinyl aromatics, for example styrene and alpha-methylstyrene. Particular preference is given to styrene. The blocks preferably have a molecular weight of from 1 000 to 50 000, preferably from 2 000 to 20 000. The A blocks are preferably monoalkenylaryl homopolymers, in particular poly(styrene).

Molecular weight refers here to comparative values of the polymer blocks or polymers measured by means of gel permeation chromatography (GPC) against poly(styrene).

Suitable B blocks are, for example, poly(olefins) which are derived from dienes, for example 1,3-butadiene, 2-methyl-1,3-butadiene (isoprene), 1,3-pentadiene, 2,3-dimethyl-1,3-butadiene, 3-butyl-1,3-octadiene, 1,3-pentadiene (piperylene), 2-methyl-1,3-pentadiene, 1,3-hexadiene, 4-ethyl-1,3-hexadiene and similar compounds. 1,3-Butadiene and isoprene are the preferred monomer units of the B blocks. These may be homopolymers or else copolymers of different olefins. In the case of butadiene homopolymers, the solubility of the additives and their ability to cocrystallize with paraffins may be influenced via the fraction of 1,4- and 1,2-polymerized units. Depending on the oil to be treated, the poly(butadiene) units preferably contain between 10 and 60%, in particular from 20 to 50%, of 1,2-configuration; butadiene copolymers preferably contain from 20 to 45 mol % of branched monomer units, for example poly(isoprene) units. In copolymers, more than 85% of the monomers preferably have 1,4-configuration.

Particularly suitable block copolymers are, for example, poly(styrene-b-butadiene-b-styrene), poly(styrene-b-isoprene-b-styrene) and poly(styrene-b-isoprene-co-butadiene-b-styrene).

The olefin blocks derived from dienes may be hydrogenated by known hydrogenation processes to reduce their degree of olefinic unsaturation. The content of olefinic double bonds is reduced in particular by 50%, preferably by at least 80%, and especially by at least 90%, for example at least 95%, of the originally present double bonds. Preferred B blocks consequently have a structure comparable to poly(ethylene), poly(ethylene-co-propylene) or poly(ethylene-co-butylene).

Branches of the middle block B may be generated by branched monomers, for example isoprene, or else by 1,2-polymerization of butadiene. The fraction of 1,2-polymerization of butadiene is adjusted by adding polar compounds such as ethers, amines and other Lewis bases and especially glycol dialkyl ethers. This gives random polymers of 1,4- and 1,2-polymerized units.

The polyolefin blocks B preferably have a molecular weight of from 1 000 to 100 000, preferably of from 2 000 to 50 000 and especially of from 5 000 to 20 000. The fraction of B blocks in the polymer and their degree of branching can be used to adjust the crystallinity of the B block and thus its solubility in the middle distillate, and also its ability to cocrystallize with the paraffins of the diesel to be additized.

The block copolymers have at least two A blocks which are separated by a B block. They are consequently tri-, tetra- and higher block copolymers. Particular preference is given to triblock copolymers which contain two monoalkenylaryl blocks and especially two polystyrene blocks. The preferred block copolymers have a linear structure, although branched and star-shaped polymers are also suitable. The A blocks may be the same or different with regard to the parent monomers, the molecular weights and the polydispersity; they are preferably derived from styrene.

Preferred block copolymers contain from 5 to 50% by weight of A blocks, preferably from 10 to 45% by weight, in particular from 20 to 40% by weight. The content of B blocks is accordingly between 50 and 95% by weight, preferably between 55 and 90% by weight and in particular between 60 and 80% by weight. Further blocks may also be present, as long as they do not fundamentally change the character of the polymers. The molecular weight of the block copolymers according to the invention is preferably between 3 000 and 200 000, especially between 6 000 and 150 000 and in particular between 10 000 and 110 000, for example between 10 000 and 50 000.

n is preferably a number in the range from 1 to 5, for example 2 or 3, and m a number in the range from 2 to 5. Particular preference is given to triblock copolymers where n=1.

The block copolymers may be prepared by customary polymerization processes, by initiation with free radicals, cationic or anionic polymerization initiators or else by grafting A blocks to the finished polymer B. Processes for bulk, solution and also emulsion polymerization are known.

In the preferred process of anionic polymerization for preparing the copolymers of monoalkenyl aromatics and olefins, the monomer to be polymerized or the monomer mixture to be polymerized are contacted simultaneously or in succession in an inert atmosphere with an organometallic compound in a suitable solvent at a temperature of from −150 to 300° C., preferably at a temperature in the range from 0 to 100° C.

Preferred initiators for the anionic polymerization are organometallic compounds and in particular organolithium compounds of the general formula $RLi_n$ where R is an aliphatic, cycloaliphatic, aromatic or alkyl-substituted aromatic hydrocarbon radical having from 1 to 20 carbon atoms and n is a number from 1 to 4. These include, for example, methyllithium, ethyllithium, n-propyllithium, isopropyllithium, n-butyllithium, sec-butyllithium, tert-butyllithium, n-pentyllithium, hexyllithium, 2-ethylhexyllithium, lithium toluene, benzyllithium, phenyllithium, tolyllithium, naphthyllithium, 1,4-dilithium-n-butane, 1,2-dilithium-1,2-diphenylethane, trimethylenedilithium, oligoisoprenyldilithium and the like. Particular preference is given to n-butyllithium, sec-butyllithium and naphthyllithium. If required, two or more of these compounds may also be used in the form of a mixture.

Suitable solvents for the polymerization include paraffins, cycloparaffins, aromatics and alkylaromatics having from 1 to 19 carbon atoms, for example benzene, toluene, cyclohexane, methylcyclohexane, n-butene, n-hexane, n-heptane and the like. To influence the microstructure, polar solvents such as tetrahydrofuran may also be added.

In addition to the sequential method for preparing triblock, tetrablock and higher repeating units, anionic polymerization may also be used to form reactive block copolymers using low molecular weight crosslinking reagents, for example organic halogen compounds (dibromoethane), halogenated alkylsilanes, alkoxysilanes, difunctional esters such dialkyl adipates and dimethacrylates, polyepoxides such as epoxidized linseed oil, polyanhydrides or polyfunctional reagents, for example divinylbenzene, polyvinylbenzene, polyvinyltoluene and oligomers of divinylbenzene. For instance, preference is given to joining identical or different diblock copolymers A-B to give symmetrical or unsymmetrical triblock copolymers. Depending on the coupling reagent used, the resulting polymer may be a linear triblock copolymer or else have a branched, cyclic or star-shaped structure. Preferred triblock copolymers are linear. The fraction of diblock copolymer which remains in the linking does not contribute to paraffin dispersancy and should therefore be as low as possible, i.e. below 25% by weight, preferably between 5 and 20% by weight.

The additives according to the invention are used as such or as concentrates in organic solvents. For easier handling, they are advantageously dissolved in organic solvents. In addition to the active ingredient, these concentrates contain from 10 to 90% by weight, preferably from 20 to 80% by weight, of solvent.

Suitable solvents or dispersants are aliphatic and/or aromatic hydrocarbons or hydrocarbon mixtures, for example benzene fractions, kerosene, decane, pentadecane, toluene, xylene, ethylbenzene or commercial solvent mixtures such as Solvent Naphtha, ®Shellsoll AB, ®Solvesso 150, ®Solvesso 200, ®Exxsol, ®ISOPAR and ®Shellsol D types. The solvent mixtures specified contain different amounts of aliphatic and/or aromatic hydrocarbons. The aliphatics may be straight-chain (n-paraffins) or branched (isoparaffins). Aromatic hydrocarbons may be mono-, di- or polycyclic and optionally bear one or more substituents. Optionally, polar solubilizers, for example butanol, 2-ethylhexanol, decanol, isodecanol or isotridecanol, or higher ethers and/or esters may also be added. In addition to the solvents based on mineral oils, solvents based on renewable raw materials are also suitable, for example biodiesel based on vegetable oils and the methyl esters derived therefrom, in particular rapeseed oil methyl ester, and also synthetic hydrocarbons which are obtainable, for example, from the Fischer-Tropsch process.

The additives according to the invention may be added to the oils to be additized individually or as a mixture. They are preferably diluted with solvents.

The block copolymers according to the invention are added to oils in amounts of from 1 to 2 000 ppm, preferably from 5 to 1 000 ppm and in particular from 10 to 100 ppm (of active ingredient). The dosages for the components I and II are typically in the range between 1 and 10 000 ppm and preferably between 10 and 1 500 ppm, in particular between 10 and 500 ppm. The ratio of the components I and II in the additive and in the additized middle distillate is between 1:10 and 1:0.1.

In a preferred embodiment, the additives according to the invention for middle distillates contain, in addition to the constituents I and II, also one or more copolymers of ethylene and olefinically unsaturated compounds as the constituent II. Suitable ethylene copolymers are in particular those which, in addition to ethylene, contain from 6 to 21 mol %, in particular from 10 to 18 mol %, of comonomers. These copolymers preferably have melt viscosities at 140° C. of from 20 to 10 000 mPas, in particular from 30 to 5 000 mPas, especially from 50 to 2 000 mPas.

The olefinically unsaturated compounds are preferably vinyl esters, acrylic esters, methacrylic esters, alkyl vinyl ethers and/or alkenes, and the compounds mentioned may be substituted by hydroxyl groups. One or more comonomers may also be present in the polymer.

The vinyl esters are preferably those of the formula 1

$$CH_2{=}CH{-}OCOR^1 \quad (1)$$

where $R^1$ is $C_1$- to $C_{30}$-alkyl, preferably $C_4$- to $C_{16}$-alkyl, especially $C_6$- to $C_{12}$-alkyl. In a further embodiment, the alkyl groups mentioned may be substituted by one or more hydroxyl groups.

In a further preferred embodiment, $R^1$ is a branched alkyl radical or a neoalkyl radical having from 7 to 11 carbon atoms, in particular having 8, 9 or 10 carbon atoms. Suitable vinyl esters include vinyl acetate, vinyl propionate, vinyl butyrate, vinyl hexanoate, vinyl heptanoate, vinyl octanoate, vinyl pivalate, vinyl 2-ethylhexanoate, and also vinyl neononanoate, vinyl neodecanoate, vinyl neoundecanoate, vinyl laurate and vinyl stearate.

The acrylic esters are preferably those of the formula 2

$$CH_2{=}CR^2{-}COOR^3 \quad (2)$$

where $R^2$ is hydrogen or methyl and $R^3$ is $C_1$- to $C_{30}$-alkyl, preferably $C_4$- to $C_{16}$-alkyl, especially $C_6$- to $C_{12}$-alkyl. Suitable acrylic esters include, for example methyl (meth)acrylate, ethyl (meth)acrylate, propyl (meth)acrylate, n- and isobutyl (meth)acrylate, hexyl, octyl, 2-ethylhexyl, decyl, dodecyl, tetradecyl, hexadecyl, octadecyl (meth)acrylate and also mixtures of these comonomers. In a further embodiment, the alkyl groups mentioned may be substituted by one or more hydroxyl groups. An example of such an acrylic ester is hydroxyethyl methacrylate.

The alkyl vinyl ethers are preferably compounds of the formula 3

$$CH_2{=}CH{-}OR^4 \quad (3)$$

where $R^4$ is $C_1$- to $C_{30}$-alkyl, preferably $C_4$- to $C_{16}$-alkyl, especially $C_6$- to $C_{12}$-alkyl. Examples include methyl vinyl ether, ethyl vinyl ether, isobutyl vinyl ether. In a further embodiment, the alkyl groups mentioned may be substituted by one or more hydroxyl groups.

The alkenes are preferably monounsaturated hydrocarbons having from 3 to 30 carbon atoms, in particular from 4 to 16 carbon atoms and especially from 5 to 12 carbon atoms. Suitable alkenes include propene, butene, isobutylene, pentene, hexene, 4-methylpentene, octene, diisobutylene, and also norbornene and its derivatives such as methylnorbornene and vinylnorbornene. In a further embodiment, the alkyl groups mentioned may be substituted by one or more hydroxyl groups.

Apart from ethylene, particularly preferred terpolymers contain from 0.1 to 12 mol %, in particular from 0.2 to 5 mol %, of vinyl neononanoate or of vinyl neodecanoate, and from 3.5 to 20 mol %, in particular from 8 to 15 mol %, of vinyl acetate, and the total comonomer content is between 8 and 21 mol %, preferably between 12 and 18 mol %. Further particularly preferred copolymers contain, in addition to ethylene and from 8 to 18 mol % of vinyl esters, also from 0.5 to 10 mol % of olefins such as propene, butene, isobutylene, hexene, 4-methylpentene, octene, diisobutylene and/or norbornene.

Preference is given to using mixtures of two or more of the above-mentioned ethylene copolymers. The parent polymers of the mixtures more preferably differ in at least one characteristic. For example, they may contain different comonomers, different comonomer contents, molecular weights and/or degrees of branching.

When the additives according to the invention contain ethylene copolymers as the constituent III, they are used in amounts of preferably from 1 to 10 000 ppm, in particular from 10 to 1 500 ppm. The mixing ratio of the constituents I, II and III is preferably between 1:10:10 and 1:0.1:0.1.

Preference is given to using the block copolymers according to the invention with further known cool additives for middle distillates. These include IV) comb polymers V) alkylphenol resins VI) olefin copolymers VII) polyoxyalkylene derivatives.

Alkylphenol-aldehyde resins are described, for example, in Römpp Chemie Lexikon, 9th edition, Thieme Verlag 1988-92, volume 4, p. 3351 ff. The alkyl radicals of the o- or p-alkylphenol in the alkylphenol-aldehyde resins which can be used in the process according to the invention may be the same or different and have 1-50, preferably 1-20, in particular 4-12, carbon atoms; they are preferably n-, iso- and tert-butyl, n- and isopentyl, n- and isohexyl, n- and isooctyl, n- and isononyl, n- and isodecyl, n- and isododecyl, octadecyl and poly(isobutenyl). The aliphatic aldehyde in the alkylphenol-aldehyde resin preferably has 1-4 carbon atoms. Particularly preferred aldehydes are formaldehyde, acetaldehyde and butyraldehyde, in particular formaldehyde. The molecular weight of the alkylphenol-aldehyde resins is 400-10 000, preferably 400-5000 g/mol. A prerequisite is that the resins are oil-soluble.

In a preferred embodiment of the invention, these alkylphenol-formaldehyde resins are oligo- or polymers having a repeating structural unit of the formula

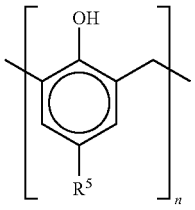

where $R^5$ is $C_1$-$C_{50}$-alkyl or -alkenyl and n is a number from 2 to 100. $R^5$ is preferably $C_4$-$C_{20}$-alkyl or -alkenyl and in particular $C_6$-$C_{16}$-alkyl or -alkenyl. n is preferably a number from 4 to 50 and especially a number from 5 to 25.

Comb polymers refer to polymers in which hydrocarbon radicals having at least 8, in particular at least 10, carbon atoms are bonded to a polymer backbone. They are preferably homopolymers whose alkyl side chains contain at least 8, and in particular at least 10 carbon atoms. In copolymers, at least 20%, preferably at least 30%, of the monomers have side chains (cf. Comb-like Polymers—Structure and Properties; N. A. Platé and V. P. Shibaev, J. Polym. Sci. Macromolecular Revs. 1974, 8, 117 ff). Examples of suitable comb polymers are, for example, fumarate/vinyl acetate copolymers (cf. EP-A-0 153 176), copolymers of a $C_6$-$C_{24}$-olefin and an N—$C_6$-$C_{22}$-alkylmaleimide (cf. EP-A-0 320 766), and also esterified olefin/maleic anhydride copolymers, polymers and copolymers of α-olefins and esterified copolymers of styrene and maleic anhydride.

Comb polymers can be described, for example, by the formula

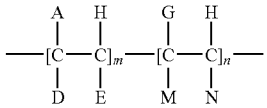

In this structure,

A is R', COOR', OCOR', R"-COOR'or OR';

D is H, $CH_3$, A or R";

E is H or A;

G is H, R", R"-COOR', an aryl radical or a heterocyclic radical;

M is H, COOR", OCOR", OR" or COOH;

N is H, R", COOR", OCOR, COOH or an aryl radical;

R' is a hydrocarbon chain having from 8 to 50 carbon atoms;

R" is a hydrocarbon chain having from 1 to 24 carbon atoms;

m is a number between 0.4 and 1.0; and n is a number between 0 and 0.6.

The mixing ratio (in parts by weight) of the additives according to the invention with comb polymers, alkylphenol resins, olefin copolymers or polyoxyalkylene derivatives is in each case from 1:10 to 20:1, preferably from 1:1 to 10:1, for example from 1:1 to 4:1.

Olefin copolymers which are suitable as a constituent of the additive according to the invention can be derived directly from monoethylenically unsaturated monomers or be prepared indirectly by hydrogenating polymers which are derived from polyunsaturated monomers such as isoprene or butadiene. Apart from ethylene, preferred copolymers contain structural units which are derived from α-olefins having from 3 to 24 carbon atoms and molecular weights of up to 120 000. Preferred α-olefins are propylene, butene, isobutene, n-hexene, isohexene, n-octene, isooctene, n-decene, isodecene. The comonomer content of olefins is preferably between 15 and 50 mol %, more preferably between 20 and 45 mol % and especially between 30 and 35 mol %. These copolymers may also contain small amounts, for example up to 10 mol %, of further comonomers, for example nonterminal olefins or nonconjugated olefins. Preference is given to ethylene-propylene copolymers.

The olefin copolymers may be prepared by known methods, for example by means of Ziegler or metallocene catalysts.

Further suitable flow improvers are polyoxyalkylene compounds, for example esters, ethers and ether/esters, which bear at least one alkyl radical having from 12 to 30 carbon atoms. When the alkyl groups stem from an acid, the remainder stems from a polyhydric alcohol (polyol); when the alkyl radicals come from a fatty alcohol, the remainder of the compound stems from a polyacid.

Suitable polyols are preferably polyethylene glycols, polypropylene glycols, polybutylene glycols and their copolymers having a molecular weight of from approx. 100 to approx. 5 000, preferably from 200 to 2 000. Also suitable are alkoxylates of polyols, for example of glycerol, trimethylolpropane, pentaerythritol, neopentyl glycol, and also the oligomers which have from 2 to 10 monomer units and are obtainable therefrom by condensation, for example polyglycerol. Preferred alkoxylates are those having from 1 to 100 mol, in particular from 5 to 50 mol, of ethylene oxide, propylene oxide and/or butylene oxide, per mole of polyol. Particular preference is given to esters.

Preference is given to using fatty acids having from 12 to 26 carbon atoms for reaction with the polyols to form the ester additives, preferably $C_{18}$- to $C_{24}$-fatty acids, especially stearic and behenic acid. The esters can also be prepared by esterification of polyoxyalkylated alcohols. Preference is given to fully esterified polyoxyalkylated polyols having molecular weights of from 150 to 2 000, preferably from 200 to 600. Particularly suitable are PEG-600 dibehenate and glycerol ethylene glycol tribehenate.

The said constituents of the additive according to the invention may also be used with known additives such as antioxidants, cetane number improvers, dehazers, demulsifiers, detergents, dispersants, antifoams, dewaxing assistants, dyes, corrosion inhibitors, conductivity improvers and/or lubricity additives.

The additives according to the invention are suitable for improving the cold flow properties of animal, vegetable or mineral oils. In particular, they disperse paraffins precipitating below the cloud point. In addition, they reduce the cloud points of the additized oils. They are particularly suitable for use in middle distillates. Middle distillates refers in particular to those mineral oils which are obtained by distilling crude oil and boil in the range from 120 to 450° C., for example kerosene, jet fuel, diesel and heating oil. The middle distillates used are preferably those which contain less than 350 ppm of sulfur, more preferably less than 200 ppm of sulfur, in particular less than 50 ppm of sulfur and in special cases less than 10 ppm of sulfur. These are generally those middle distillates which have been subjected to refining under hydrogenating conditions and therefore contain only small fractions of polyaromatic and polar compounds. Particular advantages are exhibited by additives according to the invention in oils having a low content of aromatic compounds of less than 25%, preferably less than 20% and in particular less than 18%. Aromatic compounds refers to the sum of mono-, di- and polycyclic aromatic compounds, as can be determined by means of HPLC in accordance with prEN 12916 (1997 edition). Advantages are exhibited by the additives according to the invention especially in oils having a low fraction of n-paraffins in the cold-critical chain length range of $C_{16}$-$C_{22}$ of less than 12 area %, in particular less than 10 area % and especially less than 8 area %. They are preferably those middle distillates which have 95% distillation points below 370° C., in particular 350° C. and in special cases below 340° C.

The additive mixtures according to the invention may also be used in biodiesel. "Biodiesel" or "biofuel" comprises fatty acid alkyl esters of fatty acids having from 14 to 24 carbon atoms and alcohols having from 1 to 4 carbon atoms. Typically, a relatively large portion of the fatty acids contains one, two or three double bonds. The fatty acid alkyl esters are more preferably, for example, rapeseed oil methyl ester and its mixtures with further vegetable oil esters. The additives according to the invention can be used with equal success in mixtures of fatty acid methyl esters and mineral oil diesel. Such mixtures preferably contain up to 25% by weight, in particular up to 10% by weight, especially up to 5% by weight, of fuel oil of animal or vegetable origin.

Mineral oils or mineral oil distillates improved in their cold properties by the additive mixtures contain from 0.001 to 2% by volume, preferably from 0.005 to 0.5% by volume, of the mixtures, based on the distillate.

EXAMPLES

Characterization of the Test Oils:

The CFPP value is determined in accordance with EN 116 and the cloud point is determined in accordance with ISO 3015. The n-paraffins are determined by means of gas chromatography (with FID) and baseline integration of the resulting chromatograms.

TABLE 1

Characterization of the test oils used

| Oil | CP [° C.] | $C_{16}$-$C_{22}$ [%] | Aromatics [%] | Density [g/cm$^3$] |
|---|---|---|---|---|
| Test oil 1 | −10.0 | 9.4 | 22.5 | 0.835 |
| Test oil 2 | −7.1 | 7.5 | 17.5 | 0.826 |
| Test oil 3 | −3.0 | 10.2 | 23.9 | 0.832 |

The following additives were used:

The ABA triblock copolymers used are hydrogenated triblock copolymers based on poly(styrene-b-butadiene-b-styrene). The degree of hydrogenation is more than 90% of the original double bonds. The molecular weights were determined in THF by calibration with polystyrene. The composition of the polymer was determined by $^1$H and $^{13}$C NMR spectroscopy.

TABLE 2

Characterization of the block copolymers used

| | Poly(styrene) content | $M_w$ | 1,2-Polybutadiene in the B block |
|---|---|---|---|
| A1) | 28.5% by weight | 90 300 | 34% |
| A2) | 28.0% by weight | 73 600 | 36% |
| A3) | 22.0% by weight | 24 000 | 44% |

The flow improvers used were the following additives:

TABLE 3

Characterization of the flow improvers used

| | |
|---|---|
| B1 | Terpolymer of ethylene, 30% by weight of vinyl acetate and 8% by weight of vinyl neodecanoate having a melt viscosity at 140° C. of 95 mPa s, 65% in kerosene |
| B2 | Mixture of 2 parts of a terpolymer of ethylene, 31% by weight of vinyl acetate and 9% by weight of vinyl neodecanoate having a melt viscosity at 140° C. of 220 mPa s and 1 part of a copolymer of ethylene and 31% by weight of vinyl acetate having a melt viscosity at 140° C. of 140 mPa s, 60% in kerosene |
| B3 | Mixture of equal portions of the copolymer B1 and of an ethylene-vinyl acetate copolymer having 33% vinyl acetate and a melt viscosity at 140° C. of 145 mPas, 65% in kerosene |

TABLE 3-continued

| Characterization of the flow improvers used | |
|---|---|
| C1 | Reaction product of a dodecenyl-spiro-bislactone with a mixture of primary and secondary tallow fatty amine, 60% in solvent naphtha (prepared in accordance with EP-A-0 413 279) |
| C2 | Reaction product of a terpolymer of a $C_{14}/C_{16}$-α-olefin, maleic anhydride and allyl polyglycol with 2 equivalents of secondary tallow fatty amine per mole of maleic acid anhydride, 50% in solvent naphtha (prepared in accordance with EP-A-0 606 055) |
| C3 | Reaction product of ethylene diamine tetraacetic acid and 4 equivalents of di(hydrogenated tallow fat)amine, 50% in Solvent Naphtha (prepared in accordance with EP-0 398 101) |
| C4 | Reaction product of phthalic anhydride and 2 equivalents of di(hydrogenated tallow fat)amine, 50% in Solvent Naphtha (prepared in accordance with EP-0 061 894) |
| D1 | Nonylphenol-formaldehyde resin, prepared by condensing nonylphenol with formaldehyde, $M_w$ 2 000 g/mol; 50% in Solvent Naphtha |

Effectiveness of the Additives

The cold flow performance was determined as follows:

The test oils were admixed at room temperature with the specified amounts of the optionally preheated additives, heated to 40° C. with occasional agitation and subsequently cooled to room temperature. The CFPP value (cold filter plugging point) of the middle distillate additized in this way was determined to EN 116.

The paraffin dispersancy was detected in the short sedimentation test as follows:

100 ml of the middle distillates additized as described above were cooled in measuring cylinders in a cold cabinet at −2° C./h from −1° C. to the storage temperature specified for the particular oils and stored at this temperature for 16 hours. Subsequently, volume and appearance, both of the sedimented paraffin phase and of the supernatant oil phase, were determined and assessed visually. A small amount of sediment and the cloudy oil phase show good paraffin dispersancy. A clear oil phase without sediment shows a decrease in the cloud point. In addition, the lower 20% by volume were isolated and the cloud point was determined to ISO 3015. Only a small deviation of the cloud point of the lower phase ($CP_{cc}$) from the blank value of the oil shows good paraffin dispersancy.

TABLE 4

Testing in test oil 1 (cloud point −10.2° C.; storage at −14° C.)

| | Additive A | | Additive B | | Additive C | | Additive D | | CFPP | Sediment | Oil phase | | $CP_{CC}$ | ΔCP |
|---|---|---|---|---|---|---|---|---|---|---|---|---|---|---|
| Example | A | ppm | B | ppm | C | ppm | D | ppm | [° C.] | % by vol. | % by vol. | Appearance | [° C.] | [° C.] |
| 1 (C) | — | — | B1 | 300 | — | — | — | — | −22 | 30 | 70 | cloudy | −5.5 | 4.7 |
| 2 (C) | — | — | B1 | 450 | — | — | — | — | −24 | 32 | 68 | cloudy | −7.3 | 2.9 |
| 3 (C) | A2 | 450 | — | — | — | — | — | — | −15 | 5 | 95 | cloudy | −9.5 | 0.7 |
| 4 (C) | — | — | B1 | 300 | C2 | 150 | — | — | −24 | 10 | 90 | turbid | −8.2 | 2.0 |
| 5 (C) | A1 | 150 | B1 | 300 | — | — | — | — | −21 | 36 | 64 | clear | −6.8 | 3.4 |
| 6 | A1 | 50 | B1 | 300 | C2 | 100 | — | — | −24 | 0 | 100 | clear | −10.5 | −0.3 |
| 7 | A1 | 100 | B1 | 300 | C2 | 50 | — | — | −26 | 0 | 100 | clear | −10.3 | −0.1 |
| 8 | A2 | 75 | B1 | 300 | C3 | 75 | — | — | −25 | 0 | 100 | clear | −10.2 | 0 |
| 9 | A3 | 75 | B1 | 300 | C1 | 75 | — | — | −27 | 0 | 100 | clear | −10.4 | −0.2 |
| 10 | A3 | 120 | B1 | 300 | C4 | 50 | — | — | −24 | 0 | 100 | turbid | −10.0 | +0.2 |
| 11 (C) | — | — | B1 | 300 | C2 | 100 | D1 | 50 | −24 | 3 | 97 | cloudy | −9.6 | 0.6 |
| 12 | A1 | 50 | B1 | 300 | C2 | 67 | D1 | 33 | −26 | 0 | 100 | turbid | −10.0 | 0.2 |
| 13 | A1 | 100 | B1 | 300 | C2 | 16 | D1 | 34 | −25 | 0 | 100 | turbid | −10.0 | 0.2 |
| 14 | A2 | 50 | B1 | 300 | C1 | 67 | D1 | 33 | −26 | 0 | 100 | turbid | −9.8 | 0.4 |
| 15 | A1 | 25 | B1 | 300 | C2 | 84 | D1 | 42 | −27 | 0 | 100 | clear | −10.5 | −0.3 |
| 16 | A2 | 25 | B1 | 300 | C1 | 84 | D1 | 42 | −26 | 0 | 100 | clear | −10.3 | −0.1 |
| 17 | A3 | 75 | B1 | 300 | C4 | 50 | D1 | 25 | −25 | 0 | 100 | turbid | 9.8 | 0.4 |

TABLE 5

Testing in test oil 2 (cloud point −7.1° C.; storage at −13° C.)

| | Additive A | | Additive B | | Additive C | | Additive D | | CFPP | Sediment | Oil phase | | $CP_{CC}$ | ΔCP |
|---|---|---|---|---|---|---|---|---|---|---|---|---|---|---|
| Example | A | ppm | B | ppm | C | ppm | D | ppm | [° C.] | % by vol. | % by vol. | Appearance | [° C.] | [° C.] |
| 18 (C) | — | — | B2 | 200 | — | — | — | — | −22 | 10 | 90 | clear | +0.8 | 7.9 |
| 19 (C) | — | — | B2 | 350 | — | — | — | — | −25 | 12 | 88 | clear | +1.2 | 8.3 |
| 20 (C) | A2 | 350 | — | — | — | — | — | — | −13 | 60 | 40 | clear | −3.4 | 3.7 |
| 21 (C) | A1 | 150 | B2 | 200 | — | — | — | — | −21 | 14 | 86 | cloudy | +1.1 | 8.2 |
| 22 (C) | A1 | 300 | B2 | 200 | — | — | — | — | −21 | 20 | 80 | cloudy | +0.7 | 7.8 |
| 23 (C) | A2 | 150 | B3 | 200 | — | — | — | — | −22 | 16 | 84 | cloudy | −1.2 | 5.9 |
| 24 | A1 | 75 | B3 | 200 | C1 | 75 | — | — | −23 | 12 | 88 | turbid | −4.4 | 2.7 |

TABLE 5-continued

Testing in test oil 2 (cloud point −7.1° C.; storage at −13° C.)

| | Additive A | | Additive B | | Additive C | | Additive D | | CFPP | Sediment | Oil phase | | $CP_{CC}$ | ΔCP |
|---|---|---|---|---|---|---|---|---|---|---|---|---|---|---|
| Example | A | ppm | B | ppm | C | ppm | D | ppm | [° C.] | % by vol. | % by vol. | Appearance | [° C.] | [° C.] |
| 25 | A2 | 50 | B2 | 200 | C2 | 100 | — | — | −22 | 10 | 90 | turbid | −4.1 | 3.0 |
| 26 | A3 | 25 | B3 | 200 | C4 | 125 | — | — | −21 | 15 | 85 | turbid | −3.8 | 3.3 |
| 27 (C) | — | — | B2 | 200 | C2 | 100 | D1 | 50 | −20 | 1.0 | 99 | turbid | −4.7 | 2.4 |
| 28 | A1 | 50 | B2 | 200 | C2 | 67 | D1 | 33 | −27 | <0.5 | >99.5 | turbid | −5.7 | 1.4 |
| 29 | A1 | 100 | B2 | 200 | C2 | 34 | D1 | 16 | −23 | 2 | 98 | turbid | −5.9 | 1.2 |
| 30 | A2 | 50 | B2 | 200 | C2 | 67 | D1 | 33 | −32 | <0.5 | >99.5 | turbid | −6.3 | 0.8 |
| 31 | A2 | 100 | B2 | 200 | C2 | 34 | D1 | 16 | −24 | 2 | 98 | turbid | −5.5 | 1.6 |
| 32 | A1 | 25 | B2 | 200 | C2 | 84 | D1 | 42 | −27 | 0.5 | 99.5 | clear | −6.3 | 0.8 |
| 33 | A2 | 25 | B2 | 200 | C2 | 84 | D1 | 42 | −23 | 0.5 | 99.5 | clear | −6.9 | 0.2 |
| 34 | A2 | 50 | B2 | 200 | — | — | D1 | 100 | −22 | 14 | 86 | clear | +0.8 | 7.9 |

TABLE 6

Testing in test oil 3 (cloud point −3.0° C.)
In a departure from the above-described method, the paraffin dispersancy was detected here by cooling at −3° C./h from +4° C. to −20° C. and subsequently storing at this temperature for 16 hours. A rise in the $CP_{cc}$ of less than 5° C. compared to the oil before the short sedimentation test is regarded as sufficient paraffin dispersancy.

| | Additive A | | Additive B | | Additive C | | Additive D | | CFPP | Sediment | Oil phase | | $CP_{CC}$ | ΔCP |
|---|---|---|---|---|---|---|---|---|---|---|---|---|---|---|
| Example | A | ppm | B | ppm | C | ppm | D | ppm | [° C.] | % by vol. | % by vol. | Appearance | [° C.] | [° C.] |
| 35 (C) | — | — | B3 | 500 | — | — | — | — | −18 | 26 | 74 | clear | +6.2 | 9.2 |
| 36 (C) | — | — | B3 | 800 | — | — | — | — | −20 | 33 | 67 | clear | +5.0 | 8.0 |
| 37 | A2 | 300 | B3 | 500 | — | — | — | — | −18 | 54 | 46 | clear | +2.8 | 5.8 |
| 38 | A2 | 100 | B3 | 500 | — | — | — | — | −17 | 36 | 64 | clear | +4.2 | 7.2 |
| 39 | A2 | 200 | B3 | 500 | C2 | 100 | | | −20 | 54 | 46 | turbid | −0.4 | 2.6 |
| 40 | A2 | 50 | B3 | 500 | C2 | 250 | | | −22 | 60 | 40 | cloudy | −0.6 | 0.4 |
| 41 | A3 | 50 | B3 | 500 | C1 | 250 | — | — | −21 | 72 | 28 | turbid | −0.9 | 2.1 |
| 42 | A3 | 100 | B3 | 500 | C4 | 200 | — | — | −20 | 61 | 39 | turbid | −0.1 | 2.9 |
| 43 (C) | — | — | B3 | 500 | C2 | 200 | D1 | 100 | −19 | 0 | 100 | cloudy | 0.0 | 3.0 |
| 44 | A1 | 100 | B3 | 500 | C2 | 130 | D1 | 70 | −24 | 0 | 100 | turbid | −1.0 | 2.0 |
| 45 | A1 | 50 | B3 | 500 | C2 | 165 | D1 | 85 | −25 | 0 | 100 | cloudy | −1.7 | 1.3 |
| 46 | A2 | 50 | B3 | 500 | C2 | 165 | D1 | 85 | −23 | 0 | 100 | cloudy | −1.2 | 1.8 |
| 47 | A3 | 75 | B3 | 500 | C1 | 150 | D1 | 75 | −23 | 0 | 100 | turbid | −0.9 | 2.1 |

What is claimed is:

1. A middle distillate comprising the middle distillate having a blank cloud point and from 1 to 2000 ppm of an additive for improving the cold flow performance and improving paraffin dispersancy of the middle distillate for a storage temperature below said blank cloud point, said additive comprising I) at least one paraffin dispersant which is a derivative of a fatty amine, selected from the group consisting of Ia) the reaction products of alkenyl-spiro-bislactones with amines, Ib) the reaction products of terpolymers based on α, β-unsaturated dicarboxylic anhydrides, α, β-unsaturated compounds and polyoxyalkylene ethers of lower unsaturated alcohols with fatty amines, Ic) the amides and ammonium salts of aminoalkylenepolycarboxylic acids, and Id) the reaction product of phthalic anhydride and 2 equivalents of di(hydrogenated tallow fat)amine, and II) at least one poly(styrene-b-butadiene-b-styrene) block copolymer having a molecular weight between 3000 and 110 000 g/mol, and III) one or more copolymer of ethylene and an olefinically unsaturated compound, wherein a ratio of component I to component II is between 1:10 and 1:0.1 and wherein after 16 hours at said storage temperature a resulting 20% by volume bottom oil phase having a bottom cloud point has a deviation between the blank cloud point and the bottom cloud point of less than 5 degrees C.

2. A method for improving the cold flow properties and paraffin dispersancy of a middle distillate having a blank cloud point at a storage temperature below the blank cloud point, said method comprising adding to said middle distillate from 1 to 2000 ppm of an additive comprising I) at least one paraffin dispersant which is a derivative of a fatty amine, selected from the group consisting of Ia) the reaction products of alkenyl-spiro-bislactones with amines, Ib) the reaction products of terpolymers based on α, β-unsaturated dicarboxylic anhydrides, α, β-unsaturated compounds and polyoxyalkylene ethers of lower unsaturated alcohols with fatty amines, Ic) the amides and ammonium salts of aminoalkylenepolycarboxylic acids, and Id) the reaction product of phthalic anhydride and 2 equivalents of di(hydrogenated tallow fat)amine, and II) at least one poly(styrene-b-butadiene-b-styrene) block copolymer having a molecularweight between 3000 and 110 000 g/mol, and III) one or more copolymer of ethylene and an olefinically unsaturated compound.

wherein a ratio of component I to component II is between 1:10 and 1:0.1 to provide an additized middle distillate oil which after 16 hours at the storage temperature provides a 20% by volume bottom oil phase having a bottom cloud point and wherein a deviation between the blank cloud point and the bottom cloud point is less than 5 degrees C.

3. The middle distillate of claim 1, in which the unsaturated compounds are vinyl esters having $C_1$- to $C_{30}$-alkyl groups.

4. The middle distillate of claim 1, which additionally comprises one or more additives selected from the group consisting of comb polymers, alkylphenol resins, olefin copolymers, and polyoxyalkylene derivatives.

5. The middle distillate of claim 1, wherein component Ia) is the reaction product of a dodecenyl-spiro-bislactone with a mixture of primary and secondary tallow fatty amine.

6. The middle distillate of claim 1, wherein component Ia) is the reaction product of a dodecenyl-spiro-bislactone with a mixture of primary and secondary tallow fatty amine.

7. The middle distillate of claim 1, wherein component Ib) is the reaction product of a terpolymer of a $C_{14}/C_{16}$-α-olefin, maleic anhydride and allyl polyglycol with 2 equivalents of secondary tallow fatty amine per mole of maleic acid anhydride.

8. The middle distillate of claim 1, wherein component Ic) is the reaction product of ethylene diamine tetraacetic acid and 4 equivalents of di(hydrogenated tallow fat)amine.

9. The middle distillate of claim 2, in which the unsaturated compounds are vinyl esters having $C_1$- to $C_{30}$-alkyl groups.

10. The middle distillate of claim 2, which additionally comprises one or more additives selected from the group consisting of comb polymers, alkylphenol resins, olefin copolymers, and polyoxyalkylene derivatives.

11. The middle distillate of claim 2, wherein component Ia) is the reaction product of a dodecenyl-spiro-bislactone with a mixture of primary and secondary tallow fatty amine.

12. The middle distillate of claim 2, wherein component Ia) is the reaction product of a dodecenyl-spiro-bislactone with a mixture of primary and secondary tallow fatty amine.

13. The middle distillate of claim 2, wherein component Ib) is the reaction product of a terpolymer of a $C_{14}/C_{16}$-α-olefln, maleic anhydride and allyl polyglycol with 2 equivalents of secondary tallow fatty amine per mole of maleic acid anhydride.

14. The middle distillate of claim 2, wherein component Ic) is the reaction product of ethylene diamine tetraacetic acid and 4 equivalents of di(hydrogenated tallow fat)amine.

* * * * *